United States Patent [19]

Pereira

[11] 3,951,199

[45] Apr. 20, 1976

[54] METHOD AND APPARATUS FOR LOW PRESSURE DIE CASTING

[75] Inventor: Joseph Augustine Terence Pereira, Shepperton, England

[73] Assignee: Soag Machinery Limited, Brentford, England

[22] Filed: July 26, 1974

[21] Appl. No.: 492,269

[30] Foreign Application Priority Data

Aug. 2, 1973 United Kingdom ..... 36724/73

[52] U.S. Cl. ..... 164/4; 164/119; 164/155; 164/306

[51] Int. Cl.[2] ..... B22D 17/32

[58] Field of Search ..... 164/4, 119, 155, 309; 164/154, 156, 157, 306, 321

[56] References Cited

UNITED STATES PATENTS

| | | | |
|---|---|---|---|
| 3,425,483 | 2/1969 | Dearth | 164/4 X |
| 3,844,331 | 10/1974 | Py et al. | 164/4 |

FOREIGN PATENTS OR APPLICATIONS

| | | | |
|---|---|---|---|
| 12,974 | 6/1965 | Japan | 164/155 |

*Primary Examiner*—Ronald J. Shore
*Assistant Examiner*—Gus T. Hampilos
*Attorney, Agent, or Firm*—Wolf, Greenfield & Sacks

[57] ABSTRACT

A method of low pressure die casting in which molten metal in a furnace is forced up a riser tube into the die by gas pressure applied to the surface of the molten metal in the furnace by a pressure circuit, wherein as the level of the metal in the furnace falls after each successive die filling operation, the resultant increase in the time taken to exhaust the furnace pressure is utilised to produce compensatory incremental changes in the pressure applied in the circuit. The die casting apparatus for carrying out the method includes a remotely controlled pressure control valve which is controlled by a pressure adjusting means operable during the exhausting period of the furnace to apply the incremental changes in pressure to said valve. The apparatus may employ a single or a two-stage pressurisation.

9 Claims, 2 Drawing Figures

12
3.
31
32
6
7
5
2.
4
1
35
19
17
18
11
44
43
16
25
40
10
26
15.
24
28
41
42
9
27
45
20
14
23
8
13
22
21

METHOD AND APPARATUS FOR LOW PRESSURE DIE CASTING

This invention relates to a method of and apparatus for low pressure die casting of metals.

BACKGROUND OF THE INVENTION

In a low pressure die casting apparatus, molten metal is forced upwardly through a riser tube having its lower end extending below the level of molten metal in the bath or crucible of a furnace and having an apertured cap at its upper end which is connected to the inlet of the die. The molten metal is raised by applying gas pressure to the surface of the molten metal in the furnace; the molten metal rising up the riser tube and into the die where the metal solidifies. The gas pressure is then reduced allowing excess molten metal to fall back down the riser tube to the bath or crucible in the furnace after which the die is opened to remove the casting therefrom.

As the level of the molten metal in the furnace changes due to consumption of the metal or to refilling of the bath, the pressure conditions in the apparatus change. The principal factors influencing these pressure changes are the changing volume of air in the furnace and the changing "head" pressure required to lift the molten metal to the die as the level in the furnace changes.

The invention aims at providing automatic compensation for changes in the level of the molten metal in low pressure die casting apparatus without the complexity and expense of installing level floats or magnetic or nuclear sensing devices for indicating the level of the metal.

SUMMARY OF THE INVENTION

To this end, the present invention consists in a method of low pressure die casting of metal in which molten metal in a furnace is forced upwardly into a die through a riser tube depending into the molten metal by gas pressure applied to the surface of the metal from a pressure circuit, wherein changes in the time taken to exhaust the pressure gas from the furnace, on solidification of a casting, after each die filling, due to changes in the level of metal in the furnace, is utilised to produce an incremental change in pressure in the pressure circuit to compensate for said changes in level of the metal between successive casting operations.

The present invention also consists in a low pressure die casting apparatus, comprising a furnace for molten metal, a riser tube one end of which depends into the furnace below the level of molten metal and the other end of which is connected to a die, and a pressure circuit for applying a gas pressure to the molten metal to force the molten metal upwardly into the die through the riser tube, said pressure circuit including a remotely controlled pressure control valve, wherein said valve is controlled by a pressure compensating circuit including a pressure adjusting means operable during the pressure exhausting period of the furnace after charging of the die, whereby as the duration of the pressure exhausting period increases as the level of the molten metal in the furnace falls after each successive die filling and casting operation, an incremental change in pressure is applied to said valve to compensate for the variation in said level.

The low pressure die casting apparatus may employ a single-stage or a two-stage pressurisation circuit. However, two-stage pressurisation is preferably used to reduce the time lag due to lifting the metal from the furnace to upper end of the riser tube. Such two-stage pressurisation is well known in the art. The first stage employs a higher pressure to lift the metal rapidly to the approximate die charging level and the second stage introduces a lower pressure so that the die is filled at a slower rate. The first-stage circuit preferably includes an adjustable pressure control valve, a first accumulator and a solenoid operated two-way valve controlled by a first pressure-actuated switch. A non-return valve may be included between the switch and the two-way valve, if necessary, The second stage circuit preferably includes the said remotely controlled pressure control valve, a second accumulator, a first flow control valve and a pressure-operated 3-way valve actuated by a first solenoid actuated 3-way valve.

BRIEF DESCRIPTION OF THE DRAWINGS

In order that the invention may be more readily understood, reference is made to the accompanying drawings which illustrate diagrammatically and by way of example two embodiments thereof and in which.

DETAILED DESCRIPTION OF THE DRAWINGS

Figure 1:
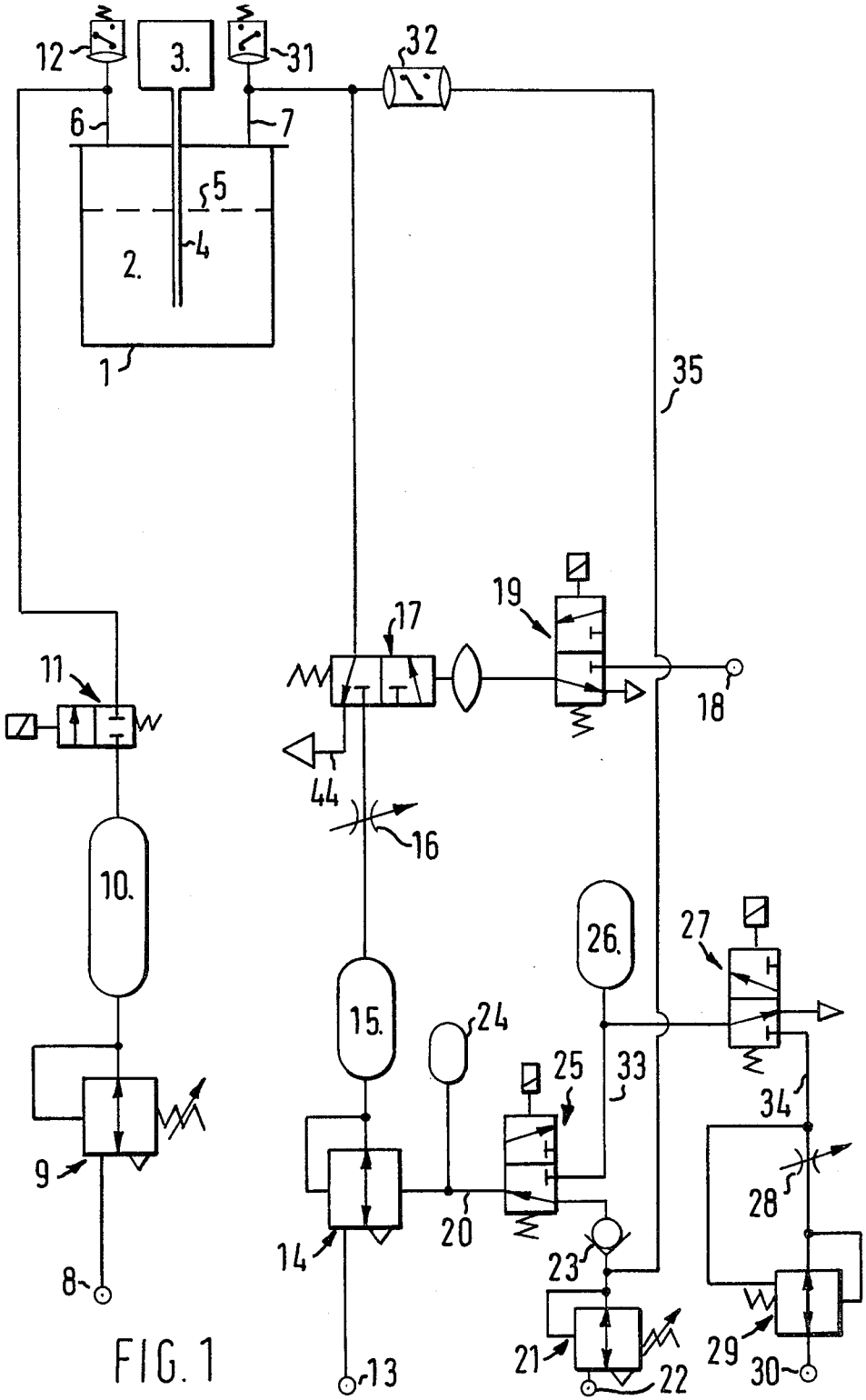
FIG. 1 is a circuit diagram of an embodiment of pressure circuit for a low pressure die casting apparatus.

Referring to FIG. 1, a hermetically sealed furnace or crucible 1 contains molten metal 2 which is fed to die 3 through a riser tube 4 the lower end of which depends into the molten metal below the level 5 of the metal and the upper end of which is connected to the charging aperture of the die 3. The molten metal is raised from the furnace to the die by gas pressure applied to the space above the metal level 5 through pipes 6 and 7 as will later be described.

A two-stage pressurisation circuit is employed as previously mentioned to reduce the time lag due to lifting the metal from the furnace 1 to the die 3.

The first stage of the pressurisation, which employs a higher pressure than the second stage to lift the metal rapidly up the riser tube 4 to the approximate die charging level, comprises a source of pressure gas 8, a first adjustable pressure control valve 9, a first accumulator 10, and a solenoid-actuated 2-way valve 11, and a first pressure-actuated switch 12 with spring bias. The pressure obtaining in the first stage is introduced into the furnace 1 by pipe 6.

The second stage of the pressurisation circuit, which is employed to fill the die at a lower pressure and at a slower rate comprises a source of pressure gas 13, a remotely controlled pressure control valve 14, a second accumulator 15, a first flow control valve 16, and a pressure operated 3-way valve 17 operated by pressure from a source 18 via a solenoid-actuated 3-way pilot valve 19. Adjustable pressure control valve 21 connected to a source of pressure 22 provides the pilot or control pressure to the valve 14 through pipe 20 as will later be described. The pressure obtaining in the second stage is introduced into the furnace 1 by pipe 7.

The metal level pressure compensation circuit comprises a non-return valve 23 in pipe 20 intermediate the second adjustable pressure control valve 21 and the remotely controlled pressure valve 14, a third accumulator 24 connected to pipe 20, a second solenoid-actuated 3-way valve 25 controlling pipe 20 and pipe 33, a fourth accumulator 26 in pipe 33, a third solenoid-actuated 3-way valve 27 controlling pipe 33 and pipe 34, a second flow control valve 28 in pipe 34, a pilot pressure operated pressure regulator 29 with a constant bias in pipe 34 fed from a pressure source 30, a second pressure operated switch 31 with a spring bias in pipe 7 and a differential pressure operated switch 32 connected in pipe 35 between pipe 7 and the second adjustable pressure control valve 21 upstream of the non-return valve 23.

Referring now to the embodiment of FIG. 2, the first and second stage pressurisation circuits are identical to those described with reference to FIG. 1. The pressure compensation circuit differes principally in that a pressure intensifier 40 replaces the valve 29 of the previous embodiment.

Figure 2:
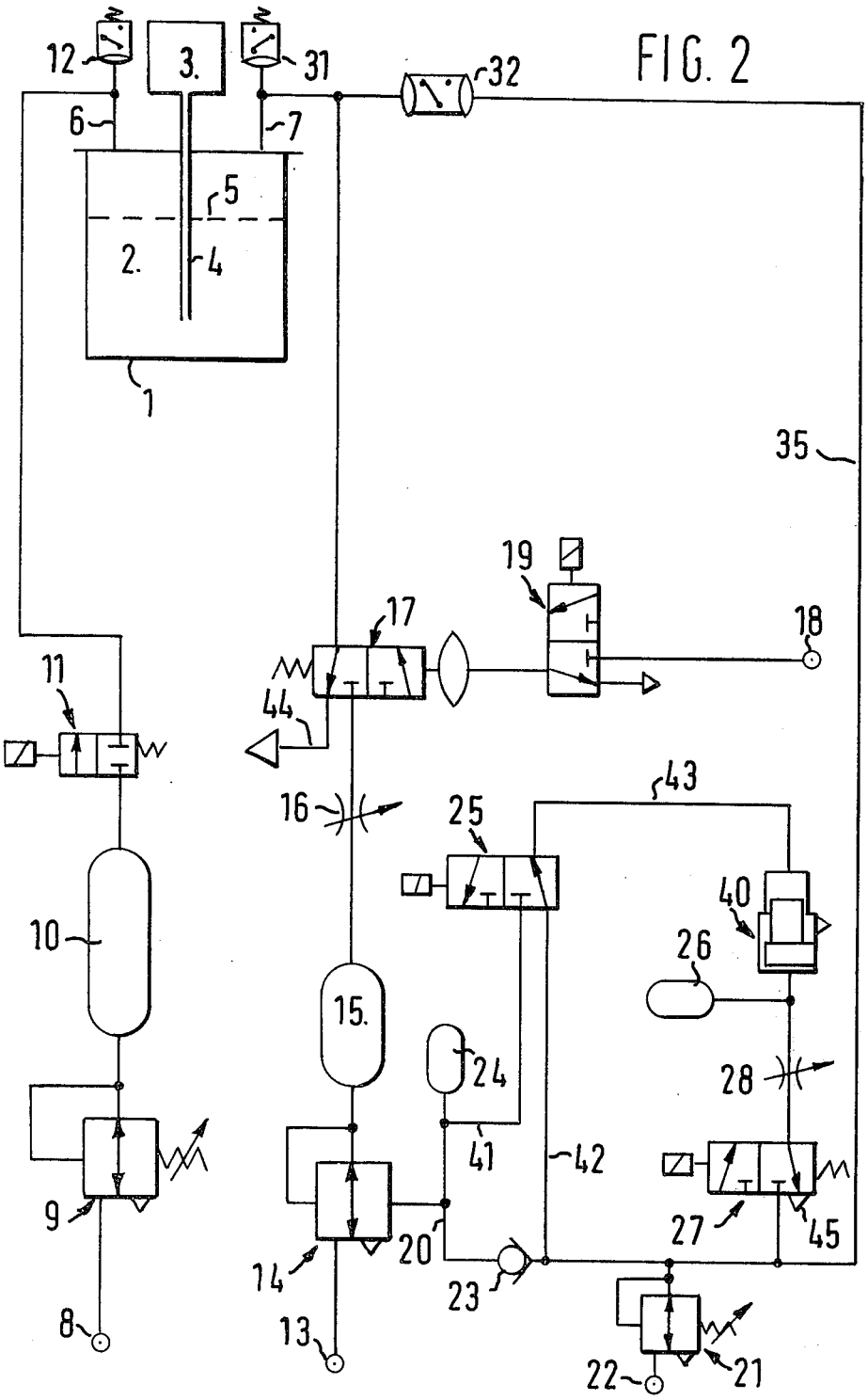
FIG. 2 is a circuit diagram of a second embodiment of pressure circuit.

The pressure compensation circuit of FIG. 2 comprises the non-return valve 23 in pipe 20 connecting the second adjustable pressure control valve 21 to the remotely controlled pressure control valve 14. The third accumulator 24 is connected in pipe 41 which is branched from pipe 20 and leads to the second solenoid-actuated 3-way valve 25 controlling pipe 43 and pipe 41 or pipe 42 which is branched off pipe 20 upstream of the non-return valve 23. Pipe 43 leads from valve 25 to the pressure intensifier 40. The fourth accumulator 26, the second flow control valve 28 and the third solenoid actuated 3-way valve 27 are connected in pipe 34 which is connected to pipe 35 interconnecting switch 32 and valve 21.

The operation of the two stage die filling is identical in both the embodiments of FIGS. 1 and 2. After the furnace has been filled the apparatus is switched on by simultaneously energising the solenoid-actuated valves 11 and 19. Any suitable control circuit known in the art can be used. It is essential that the valve 19 relating to the second stage pressurisation circuit and thus also the valve 17 must be actuated simultaneously with the valve 11 of the first stage otherwise the pressure introduced in the furnace by the first stage would immediately be vented by valve 17 at 44. Thus both stages of the pressurisation circuit are operative but the rapid lifting of the molten metal through the riser tube 4 from the furnace to approximately the level of the entrance to the die 3 is substantially effected by the first stage pressure. When the desired level in the tube 4 is reached a pre-determined back pressure or head is built up which actuates switch 12 to de-energise valve 11 to shut off pipe 6 from the accumulator 10. Filling of the die 3 now proceeds by virtue of the lower pressure and reduced rate of flow supplied by the second stage through pipe 7.

After the die has been filled the pressure is maintained for a pre-determined period to allow the metal to solidify. This is effected by a suitable delay circuit incorporated in the control circuit in the usual manner. After the delay has expired, solenoid actuated valve 19 is de-energised to operate valve 17 to open the vent 44 to exhaust the pressure in the furnace and allow the molten metal in the riser tube 4 to fall by gravity into the furnace 1.

In the embodiment of FIG. 1, the metal level compensation circuit operates as follows:

During die filling and solidification of the casting both solenoid valves 25 and 27 are de-energised, the accumulator 26 is exhausted but the pressure in accumulator 24 is locked in by the non-return valve 23. During exhaust of the furnace 1 the molten metal in the riser tube 4 falls back into the furnace as previously described. When the furnace pressure falls, the differential pressure switch 32 changes its state and energises the solenoid valves 25 and 27.

Initially the gas stored in the accumulator 24 expands, via pipe 20, valve 25 and pipe 33, into the accumulator 26 which is of larger volume than accumulator 24. At the same time, the pressure in both accumulators 24 and 26 begins to rise at a rate determined by the flow control valve 28. Control valve 29 maintains a constant volume gas flow through flow control valve 28.

When the furnace drops to a pre-determined low level, pressure switch 31 changes its state and de-energises both solenoid valves 25 and 27 which return to the position shown in the drawing. The pressure built up in accumulator 24 is locked in by the non-return valve 23 to provide the pilot pressure for the pressure control valve 14 which is thereby adjusted for the next casting operation. At the same time the pressure built up in the accumulator 26 is vented at 45 through valve 27. As the metal level 5 drops with successive die fillings, the time taken to charge the accumulator 24 increases because there is a larger volume of air in the furnace to be exhausted which results in progressive incremental increases in the pilot pressure stored in the accumulator 24.

When it is required to re-charge the furnace, after completion of a casting series, the first die filling after recharging will be at the pilot pressure last set in accumulator 24 and a faulty casting may result. However, due to the substantially reduced exhaust time as a result of the high level of metal in the re-charged furnace, the pilot pressure set for the next casting operation will be at a lower compensated value so that the second and subsequent castings in the new series will be correct.

To avoid the necessity of rejecting the first faulty casting, solenoid valve 25 can be operated to vent accumulator 24 through pipes 20 and 33 and valve 27 at 45, to allow pressure in the circuit to drop to the pre-set datum pressure set by valve 21. This may be done manually by actuation of a suitable switch or such switch may be automatically operated, for example, by the action of lifting the lid or cover of the furnace for recharging.

In the embodiment of FIG. 2, the metal level compensation circuit operates as follows:

During die filling and solidification of the casting both solenoid valves 25 and 27 are de-energised, the accumulator 26 is exhausted by the pressure in accumulator 24 is locked in by the non-return valve 23. During exhaust of the furnace 1 the molten metal in the riser tube 4 falls back into the furnace as previously described. When the furnace pressure falls to the datum pressure set by the pressure control valve 21, the differential pressure switch 32 changes its state and energises the solenoid valves 25 and 27.

After the first die filling, accumulator 24 and pressure intensifier 40 will be at the same pressure i.e. the datum pressure set by valve 21. The pressure in accumulator 26, which was exhausted during die filling, begins to rise at a rate controlled by flow control valve 28. As the pressure rises in accumulator 26 the piston of the accumulator 40 is gradually loaded and depending on the time taken for the furnace pressure to drop to the predetermined low level to operate switch 31 as in the previous embodiment, the piston of the intensifier will move slightly further than the position it assumed at the previous shot thus forcing the gas therein into the accumulator 24 to increase the pressure in the latter by an incremental addition to the pilot pressure for valve 14 stored therein.

When the furnace pressure drops to the pre-determined low level, pressure switch 31 changes its state and de-energises both valves 25 and 27 which return to the position shown in the drawing. The pressure built up in accumulator 24 is locked in by non-return valve 23 to provide the pilot pressure for the pressure control valve 14 which is thereby adjusted for the next casting operation. At the same time the pressure built up in accumulator 26 is vented at 45 through valve 27. As the metal level 5 drops with successive castings, the time the piston of the pressure intensifier 40 is under load from the accumulator 26 is increased which results in progressive incremental increases in the pilot pressure stored in accumulator 24.

As in the previous embodiment, the first die filling after re-charging of the furnace will be at the incrementally increased higher pressure last set in the accumulator 24 and a faulty casting may result. Unlike the previous embodiment this cannot be avoided and must be rejected. However, after the first die filling the pressure stored in accumulator 24 will be of the requisite lower value determined by the shortened exhaust time for the substantially fully charged furnace.

Whilst the invention has been described with reference to specific embodiments employing two-stage pressurisation, it can equally be applied to single stage pressurisation, the compensation circuit remaining the same.

I claim:

1. A method of low pressure die casting of metal in which molten metal in a furnace is forced upwardly into a die through a riser tube depending into the molten metal by gas pressure applied to the surface of the metal from a pressure circuit, wherein changes in the time taken to exhaust the pressure gas from the furnace, on solidification of a casting, after each die filling, due to changes in the level of metal in the furnace, is utilised to produce an incremental change in pressure in the pressure circuit to compensate for said changes in level of the metal between sucessive casting operations.

2. Method as claimed in claim 1, wherein the compensatory change in pressure is obtaind as a function of the time taken to exhaust the gas pressure in the furnace between a reference pressure at a pre-set value and a lower pressure represented by the exhausted condition of the furnace.

3. A low pressure die casting apparatus, comprising a furnace for molten metal, a riser tube one end of which depends into the furnace below the level of molten metal and the other end of which is connected to a die, and a pressure circuit for applying a gas pressure to the molten metal to force the molten metal upwardly into the die through the riser tube, said pressure circuit including a remotely controlled pressure control valve, wherein said valve is controlled by a pressure compensating circuit including a pressure adjusting means operable during the pressure exhausting period of the furnace after charging of the die, whereby as the duration of the pressure exhausting period increases as the level of the molten metal in the furnace falls after each successive die filling and casting operation.

4. An apparatus as claimed in claim 3, and further comprising means providing a two stage pressurisation circuit, said pressurisation circuit comprising a first stage circuit employing a higher pressure than a second stage and being used to lift the molten metal rapidly from the level in the furnace substantially to the die charging level, and the second stage circuit being used to fill the die at a slower rate.

5. An apparatus as claimed in claim 4, wherein said first stage circuit includes a first adjustable pressure control valve for regulating first stage pressure, a first accumulator for storing air at first stage pressure and a solenoid actuated 2-way valve for controlling introduction of first stage pressure and controlled by a first pressure actuated switch for monitoring furnace pressure and terminating first stage.

6. An apparatus as claimed in claim 4, wherein said second stage circuit includes said remotely controlled pressure control valve for regulating second stage pressure, a second accumulator for storing air at second stage pressure, a first flow control valve for controlling the rate of flow of second stage air, a pressure operated 3-way valve for controlling admission of second stage and air exhaust and being actuated by a first solenoid actuated 3-way valve.

7. An apparatus as claimed in claim 6, wherein the remotely controlled pressure control valve is controlled by a second adjustable pressure control valve acting as a pilot valve for said last mentioned valve and further acting to set basic second stage pressure.

8. An apparatus as claimed in claim 7, wherein said pressure compensating circuit comprises a non-return valve for enabling pilot pressure at a compensated level, a third accumulator for storing pilot pressure at a compensated level, a second solenoid-actuated 3-way valve for allowing relaxation of air pressure in the third and fourth accumulators and subsequent recovery to compensated pressure level, a third solenoid-actuated 3-way valve for providing an entry for air to recover pressure in the third and fourth accumulator to a compensated level, a second flow control valve for regulating the rate of pressure recovery, a pilot operated pressure regulator with constant bias for regulating pressure to achieve linearity through the second flow control valve, a second pressure actuated switch for de-activating on falling furnace pressure to de-energize the second and third solenoid 3-way valves, and a differential pressure-actuated switch which activates on initial fall of furnace pressure to energize the second and third solenoid actuated 3-way valves and initiate compensation.

9. An apparatus as claimed in claim 7, wherein said pressure compensating circuit comprises a non-return valve for enabling pilot pressure at a compensated level, a third accumulator for storing pilot pressure at a compensated level, a second solenoid-actuated 3-way valve for allowing relaxation of air pressure in the third and fourth accumulators and subsequent recovery to compensated pressure level and for resetting a pressure intensifier, a pressure intensifier for recovering pressure in the third accumulator to compensated level, a fourth accumulator for providing a volume for air in the third accumulator to relax its pressure, a second flow control valve for regulating the rate of pressure recovery, a third solenoid-actuated 3-way valve for providing an entry for air to recover pressure in the fourth accumulator to a second stage setting and in the third accumulator to a compensated value, a second pressure actuated switch for de-activating on falling furnace pressure to de-energize the second and third solenoid 3-way valves, and conclude compensation and a differential pressure actuated switch which activates on initial fall of furnace pressure to energize the second and third solenoid actuated 3-way valves and initiate compensation.

* * * * *

UNITED STATES PATENT OFFICE

CERTIFICATE OF CORRECTION

Patent No. 3,951,199 Dated Apr. 20, 1976

Inventor(s) Joseph Augustine Terence Pereira

It is certified that error appears in the above-identified patent and that said Letters Patent are hereby corrected as shown below:

Claim 3; column 6, line 2, after "operation" change "." to --,-- and add --an incremental change in pressure is applied to said valve to compensate for the variation in said level. --

Signed and Sealed this

Fourteenth Day of June 1977

[SEAL]

*Attest:*

RUTH C. MASON
*Attesting Officer*

C. MARSHALL DANN
*Commissioner of Patents and Trademarks*